US010010128B2

(12) United States Patent
Zhang

(10) Patent No.: US 10,010,128 B2
(45) Date of Patent: Jul. 3, 2018

(54) ONE-PIECE CAP AND MAKING METHOD THEREOF

(71) Applicant: Hongwei Zhang, Wuchuan (CN)

(72) Inventor: Hongwei Zhang, Wuchuan (CN)

( * ) Notice: Subject to any disclaimer, the term of this patent is extended or adjusted under 35 U.S.C. 154(b) by 0 days.

(21) Appl. No.: 15/299,474

(22) Filed: Oct. 21, 2016

(65) Prior Publication Data

US 2018/0110282 A1 Apr. 26, 2018

(51) Int. Cl.
*A42C 1/04* (2006.01)
*A42B 1/06* (2006.01)
*A42B 1/00* (2006.01)

(52) U.S. Cl.
CPC ..... *A42C 1/04* (2013.01); *A42B 1/004* (2013.01); *A42B 1/062* (2013.01)

(58) Field of Classification Search
CPC ..... A42C 1/04; A42B 1/004; A42B 1/062; A42B 1/06; B29C 45/16; B29C 45/74
USPC ..... 2/175.1, 175.2, 175.3, 195.1
See application file for complete search history.

(56) References Cited

U.S. PATENT DOCUMENTS 6,158,053 A * 12/2000 Wang ..... A42B 1/004 2/175.1
2016/0193765 A1* 7/2016 Chan ..... B29C 45/16 2/195.1

* cited by examiner

*Primary Examiner* — Gloria Hale

(57) ABSTRACT

A one-piece cap comprising the cap made by a hot press forming method, including a bowl-shaped cap body and a cap visor connected with the cap body; the method of making the one-piece cap comprising steps of preheating a hot pressing die, preheating a hot pressing die, pressing and shaping materials, cutting off the excessive material, and trimming for a bound edge; the one-piece cap being made without sewing or bonding the cap body and the cap visor separately in the manufacturing process, and therefore, reducing the production procedures and costs, and saving the production time and the manual labor, thus the one-piece cap has simple structure and beautiful appearance with more round and smooth lines.

4 Claims, 2 Drawing Sheets

ONE-PIECE CAP AND MAKING METHOD THEREOF

TECHNICAL FIELD

The present invention relates to a cap technical field, particularly to a one-piece cap and making method thereof.

BACKGROUND OF THE INVENTION

The cap is a headwear and most caps can cover the entire top of the head, thus mainly used to protect the head. Some caps may have the prominent edge to shade the sunray, so the cap has such functions as sun-shading, decoration, temperature increase and protection, etc. So there are caps of all varieties, requiring the meticulous selection.

The cap can also be sued for adornment. First of all, it is necessary to select the proper cap according to the facial form. Then, it is better to select the cap according to your stature or figure. Just like clothes, you'd better make best use of advantages and bypass disadvantages in selecting a cap. The cap must be well matched with the clothes in style and color, etc. Caps can protect the hairstyle or cover up the bald head or can be used as an integral part of the uniform or religious dress, so the headgear has various kinds, say, top caps and sun helmets, etc. Some caps have the outwardly extended canopy, also referred to as the visor. Wearing a cap or hat has different etiquettes in different cultures, which is particularly important in the Western Culture, so wearing a cap or hat in the past represents a symbol of social identity.

The current caps, in general, are composed of the most basic two parts, the cap body and the visor. The former means the bowl-shaped cap body quite similar to the head and the brim or visor connected with the cap body. In view of the current technology, the cap body and the visor are generally sewn or otherwise connected. All in all, the cap body and the visor are separately made and then pieced together into the finished product. This method, in view of the manufacturing process, is comparatively complicated. With a view to further reducing the manufacturing procedures and saving the manual labor, simplifying the entire cap production line, the present invention provides a one-piece cap and making method thereof.

DESCRIPTION OF THE INVENTION

The objection of the present invention is to overcome the deficiency of the current technology by providing a one-piece cap and making method thereof.

In order to solve the above-mentioned problems and achieve the objective of the present invention, the technical scheme is to provide a one-piece cap, comprising: the cap made by a hot press forming method, including a bowl-shaped cap body and a cap visor connected with the cap body.

More particularly, wherein the cap is composed of at least two layers of flexible material (10); the cap body and the cap visor are formed between the two layers of flexible material (10) through a hot pressing die.

More particularly, wherein the cap visor comprises a fixing board integrally formed with the flexible material by hot press forming method for improving the hardness of the cap visor; the fixing board is disposed between the flexible materials, whereby a pressing edge part is formed at a joint between the cap visor and the cap body.

More particularly, wherein the flexible material is at least two of fabric, sponge, TPU, PPC and PU.

More particularly, wherein the cap is formed with a bound edge around an outer edge thereof.

A method of making a one-piece cap, comprising:

preheating a hot pressing die, the hot pressing die including a raised cap-shaped upper die and a concave cap-shaped lower die arranged correspondingly to the upper die; selecting at least two high-temperature resistant materials, and feeding the materials into the hot pressing die and arranged neatly therein; pressing the materials via the upper and lower die and executing a hot-pressing operation for forming a one-piece cap; removing the cap out of the hot pressing die, cooling and shaping; cooling and shaping; cutting off the excessive material from the cap to have the cap shape as required; trimming an outer edge of the cap for a seamless or a seamed bound edge as required; and f forming the one-piece cap with a bowl-shaped cap body (11) and a cap visor (12) connected with the cap body (11) through the hot pressing process.

More particularly, wherein the high-temperature resistant materials includes fabric, sponge, TPU, PPC and PU; the temperature of the hot-pressing operation for forming a one-piece cap is 190-200 degrees Celsius.

More particularly, wherein a position arranged in the hot pressing die, is where the cap body can be shaped as a bowl from the materials by the hot-pressing operation.

More particularly, wherein the cap body comprises a logo printed thereon.

Accordingly, this invention has the following beneficial effects compared with the current technology: the one-piece cap is made without sewing or bonding the cap body and the cap visor separately in the manufacturing process, and therefore, reducing the production procedures and costs, and saving the production time and the manual labor. The one-piece cap in the present invention has simple structure and beautiful appearance with more round and smooth lines.

DETAILED DESCRIPTION OF THE INVENTION

Detailed descriptions are provided below based on the embodiment depicted in the accompanying draws.

Figure 1:
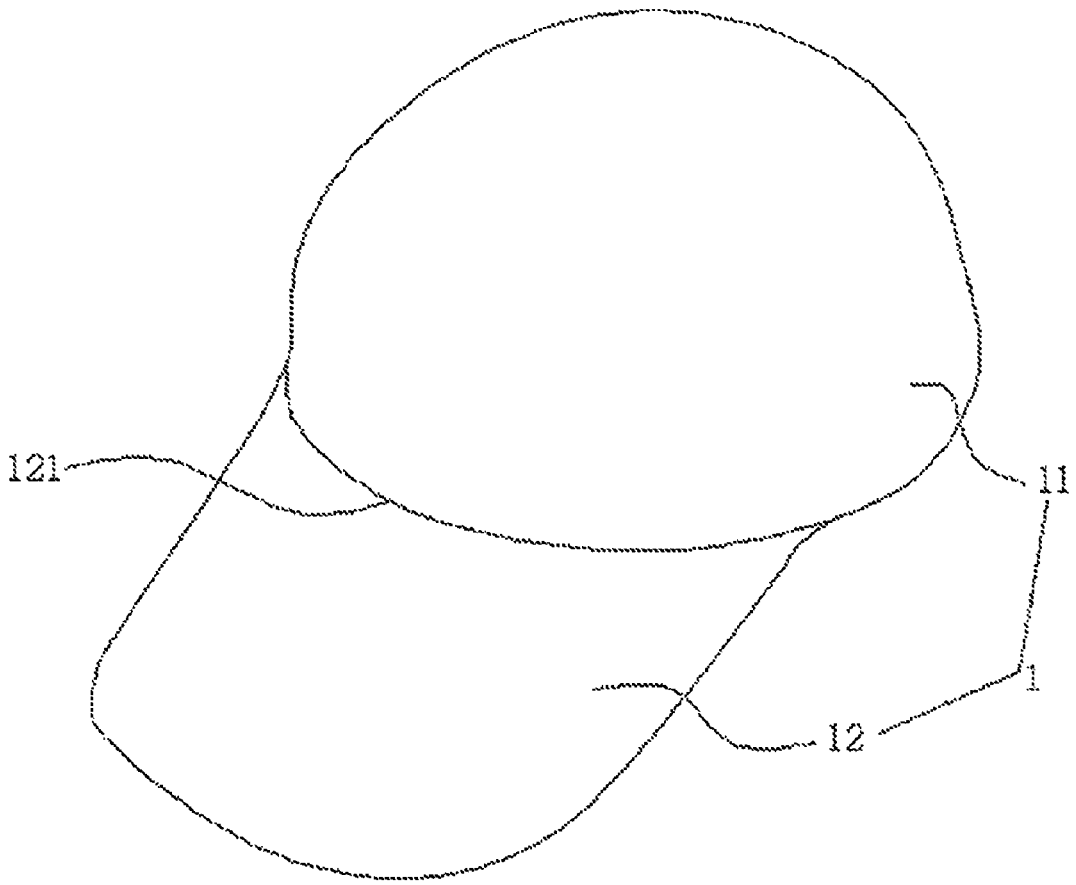
FIG. 1 is a perspective view of a one-piece cap of the present invention.
Figure 2:
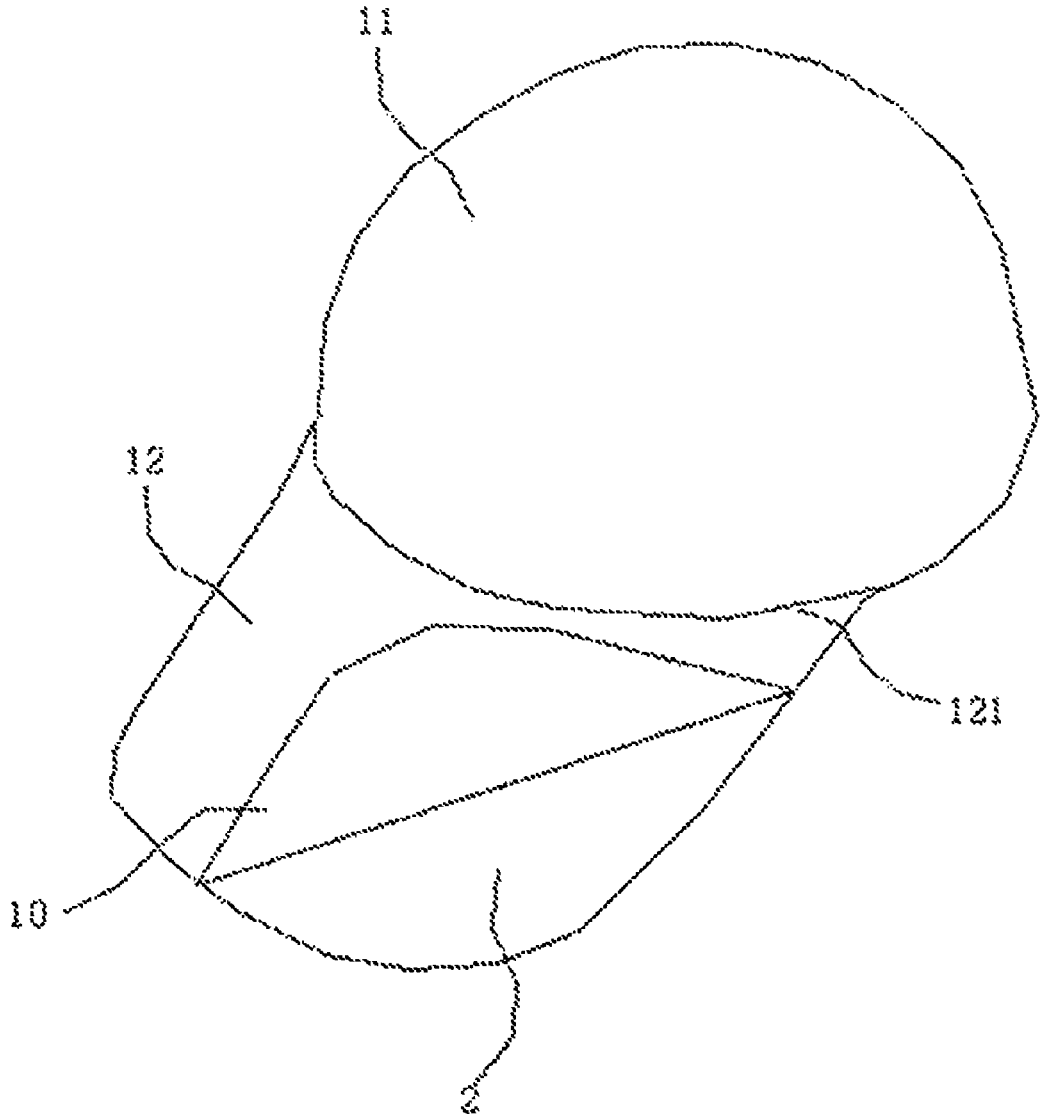
FIG. 2 is a structural schematic view of the one-piece cap of the present invention.

As illustrated in FIGS. 1-3, a one-piece cap comprises the cap (1) made by a hot press forming method, including a bowl-shaped cap body (11) and a cap visor (12) connected with the cap body (11).

Specifically speaking, the cap visor (12) comprises a fixing board (2) integrally formed with the flexible material (10) by hot press forming method for improving the hardness of the cap visor (12), whereby a pressing edge part (121) is formed at a joint between the cap visor (12) and the cap body (11).

Wherein the flexible material (10) is at least two of fabric, sponge, thermoplastic polyurethanes (TPU), polypropylene copolymer (PPC) and polyurethane (PU).

The cap (1) is formed with a bound edge around an outer edge thereof as required.

A method of making a one-piece cap comprises steps of (1) preheating a hot pressing die, the hot pressing die including a raised cap-shaped upper die and a concave cap-shaped lower die arranged correspondingly to the upper die;

(2) selecting at least two high-temperature resistant materials, and feeding the materials into the hot pressing die and arranged neatly therein; wherein the high-temperature resistant materials include fabric, sponge, thermoplastic polyurethanes (TPU), polypropylene copolymer (PPC) and polyurethane (PU), and others; three materials are selected in the preferred embodiment, respectively the fabric, sponge and TPU, which are being flattened and overlapped on the hot pressing die, and then a fixing board is placed among the materials and correspondingly arranged to the cap visor;

(3) pressing the materials via the upper and lower die and executing a hot-pressing operation for forming a one-piece cap; wherein the temperature of the hot-pressing operation for forming a one-piece cap is 190-200 degrees Celsius; the temperature of the preferred embodiment is 190 degrees Celsius, and the hot-pressing time shall not be more than 300 seconds;

(4) removing the cap out of the hot pressing die, cooling by blowing the cold wind, and shaping;

(5) cutting off the excessive material from the cap to have the cap shape as required; wherein a position arranged in the hot pressing die is where the cap body (11) can be shaped as a bowl from the materials by the hot-pressing operation;

(6) trimming an outer edge of the cap for a seamless or a seamed bound edge as required; and (7) forming the one-piece cap with a bowl-shaped cap body (11) and a cap visor (12) connected with the cap body (11) through the hot pressing process.

Besides, the cap body (11) can be printed with a logo thereon as required.

Accordingly, the cap body (11) and the cap visor are made in one piece thereby greatly simplifying the production procedures, saving the manual operation, and improving the cap manufacturing method.

The above shows and describes the fundamental principles, major characteristics and advantages of the present invention. Those skilled in the art shall understand that the present invention is not limited by the foregoing embodiments, and the foregoing embodiments and description only explain the principles of the present invention. The present invention may also have various modifications and improvements without departing from the spirit and scope of the present invention, these various modifications and improvements shall all fall within the protection scope of the present invention claimed which is defined by the appended claims and equivalents thereof.

I claim:

1. A molded one-piece cap, comprising:

the cap (1) being integrally formed by thermo-compression molding and forming a bowl-shaped cap body (11) and a cap visor (12);

wherein the cap (1) is composed of at least two flexible materials (10) and the two flexible materials are integrally formed into the cap body (11) and the cap visor (12) through thermo-compression molding;

wherein the flexible material (10) is at least two of fabric, sponge, thermoplastic polyurethane (TPU), propylene carbonate (PPC) and Polyurethane (PU).

2. The molded one-piece cap according to claim 1, wherein the cap visor (12) includes a fixing board (2) integrally formed with the flexible materials (10) by thermo-compression molding to increase hardness of the cap visor (12); the fixing board (2) is sandwiched between the flexible materials (10) to form a pressing edge part (121) at a junction between the cap visor (12) and the cap body (11).

3. A method of making-a one-piece cap, comprising:

preheating a molding die, the molding die including a raised cap-shaped upper die and a concave cap-shaped lower die arranged correspondingly to the upper die;

selecting at least two temperature resistant materials, and feeding the materials into the molding die and arranged neatly therein;

pressing the materials via the upper and lower die and executing a thermo-compression molding operation for forming a cap;

removing the cap out of the molding die, cooling and shaping;

cutting off excessive material from the cap to have the cap shape as required;

trimming an outer edge of the cap to form a seamless cap; and forming the one-piece cap with a bowl-shaped cap body (11) and a cap visor (12) connected with the cap body (11) through the thermo-compression molding process;

wherein the temperature resistant materials includes fabric, sponge, thermoplastic polyurethane (TPU), propylene carbonate (PPC) and Polyurethane (PU); the temperature of the thermo-compression molding operation for forming a one-piece cap is 190-200 degrees Celsius.

4. The method of making one-piece cap according to claim 3, wherein a position arranged in the molding die is where the cap body (11) is shaped as a bowl from the materials by the thermo-compression molding operation.

* * * * *